US008220845B2

(12) United States Patent
Mallory

(10) Patent No.: US 8,220,845 B2
(45) Date of Patent: Jul. 17, 2012

(54) EXHAUST MANIFOLD CLAMP APPARATUS

(76) Inventor: Curtis G. Mallory, Degraft, OH (US)

( * ) Notice: Subject to any disclaimer, the term of this patent is extended or adjusted under 35 U.S.C. 154(b) by 541 days.

(21) Appl. No.: 12/404,949

(22) Filed: Mar. 16, 2009

(65) Prior Publication Data

US 2009/0232615 A1 Sep. 17, 2009

Related U.S. Application Data

(60) Provisional application No. 61/036,779, filed on Mar. 14, 2008.

(51) Int. Cl.
*F16L 23/02* (2006.01)
*F16L 23/12* (2006.01)

(52) U.S. Cl. ..... 285/412; 285/62; 285/420

(58) Field of Classification Search ..... 285/62, 285/368, 412, 420, 421; 411/400, 401
See application file for complete search history.

(56) References Cited

U.S. PATENT DOCUMENTS 1,606,480 A * 11/1926 Reilly ..... 411/198
2,478,487 A * 8/1949 Katzenmeyer et al. ..... 285/406
3,199,815 A * 8/1965 Martinkovic et al. ..... 248/59
4,109,694 A * 8/1978 Jones ..... 285/15
4,113,289 A * 9/1978 Wagner et al. ..... 285/322
4,311,326 A * 1/1982 Ringle ..... 285/62
4,377,301 A * 3/1983 Craig et al. ..... 285/62
4,571,912 A * 2/1986 Fricker ..... 52/710
4,615,500 A * 10/1986 Layson ..... 248/65
4,623,182 A * 11/1986 Trabert et al. ..... 293/155
4,643,458 A * 2/1987 Ammar ..... 285/62
4,649,614 A 3/1987 Lund
4,892,331 A * 1/1990 Wollner et al. ..... 280/801.2
5,127,224 A * 7/1992 Barcza et al. ..... 60/763
5,333,917 A * 8/1994 Davey et al. ..... 285/205
5,474,274 A * 12/1995 Bernosky ..... 248/317
5,784,906 A * 7/1998 Moore ..... 70/57
RE36,206 E * 5/1999 Borneby ..... 277/627
6,234,541 B1 * 5/2001 Wagner et al. ..... 285/197
2003/0106968 A1 * 6/2003 Terrill et al. ..... 248/58
2006/0076777 A1 * 4/2006 Pirrone ..... 285/420
2006/0170214 A1 8/2006 Valente
2006/0196049 A1 * 9/2006 Opperman ..... 29/890.08
2007/0001445 A1 * 1/2007 Reeves ..... 285/15
2010/0181767 A1 * 7/2010 Kozal ..... 285/382.5

* cited by examiner

*Primary Examiner* — James Hewitt
(74) *Attorney, Agent, or Firm* — Standley Law Group LLP

(57) ABSTRACT

Embodiments include a clamp apparatus for use in facilitating repair of an exhaust manifold. Some exemplary embodiments of the clamp may include a frame that includes an aperture that is adapted to be secured around a protrusion of an exhaust manifold. Additionally, the clamp may include a fastener secured to the frame that is adapted to join with an exhaust pipe flange having mating holes for receiving the fastener or each clamp. Two clamps are used in one exemplary embodiment.

6 Claims, 3 Drawing Sheets

EXHAUST MANIFOLD CLAMP APPARATUS

CROSS-REFERENCE TO RELATED APPLICATIONS

This application claims priority of U.S. Provisional Patent Application No. 61/036,779, filed Mar. 14, 2008, which is incorporated by reference as if fully recited herein.

BACKGROUND AND SUMMARY OF THE INVENTION

Exemplary embodiments of the present invention relate generally to a clamping apparatus and method of applying. More specifically, exemplary embodiments relate to an exhaust manifold clamp apparatus and method of applying the clamp.

Automobiles, trucks and other vehicles or equipment, which are equipped with an exhaust system for internal combustion motors, are typically attached to the exhaust components by a number of different processes. One such process of attachment occurs at the junction of the exhaust manifold(s) and the exhaust piping. Ordinarily, the joining system includes an exhaust manifold, exhaust manifold studs, or bolts, which secure the exhaust piping to the manifold in conjunction with a flange arrangement on the exhaust piping, and appropriate mating manifold nuts that twist onto the studs or bolts.

In an ordinary arrangement, the exhaust manifold studs are secured to the exhaust manifold by threading them into the manifold casting. Subsequently, these manifold studs are of such a length that they may pass through corresponding exhaust piping flange holes, which are attached to the exhaust piping. The attachment of the assembly is then secured by twisting the manifold nuts onto the corresponding studs and tightening the nuts to a vehicle-specific torque.

Sometimes, the aforementioned exhaust system components have a useful life which is long enough in duration to result in some of the attachment components deteriorating through a normal oxidizing (rusting) process. This is especially true in areas where salt is used to melt snow and ice on roadways. The deterioration may result in an attachment component that cannot be serviced or restored during a normal restoration of the exhaust system. Usually, all of the components of the normal attachment assembly are removed and new parts are installed, restoring the attachment to its original condition. However, in some instances the deterioration is of such significance that exhaust manifold studs cannot be re-used and the studs may be permanently seized in place.

The stud may seize within the exhaust manifold due to the oxidizing process, wherein removal of the entire existing manifold studs cannot occur without causing irreversible damage to the exhaust manifold casting. In such an example, the normal removal process for the studs may result in breakage of the existing stud so as to make removal of the remainder of the stud impractical or impossible while the exhaust manifold is still attached to the motor. One way to salvage the exhaust manifold is to drill out the stud and re-tap the hole. However, this procedure is typically labor intensive and costly, with no guarantee of successful results. An unsuccessful attempt of servicing the exhaust manifold casting on or removed from the motor may result in total replacement of the subject exhaust manifold(s).

Consequently, there is a need for an apparatus and method that allows for successful restoration of the exhaust manifold attachment to the exhaust piping without damaging the exhaust manifold and avoiding the inherent need to remove the exhaust manifold from the motor to achieve the restoration. An exemplary embodiment of the apparatus of the present invention comprises two clamps, each having a void or opening adapted to accommodate opposing "manifold ears" plus tightening fasteners for securing in place the manifold to an exhaust piping flange.

In practicing exemplary embodiments of the method it may be necessary to remove the existing damaged studs from the exhaust manifold. Typically, a lower end portion of the existing damaged studs may be cleared from the exhaust manifold by several known methods common to a muffler installation repair facility. The removal of at least a portion of the existing studs is normally accomplished while the exhaust manifold is mounted on the motor. After the existing studs are removed in whole or in part, an installer may secure the clamp to the exhaust manifold by placing the clamps over opposing protrusions of the exhaust manifold, sometimes commonly called "manifold ears", and preferably engaging at least a portion of the opening or aperture of each clamp with the protrusions of the exhaust manifold in a manner so that the fastener of each clamp is aligned in a position which substantially mirrors the original position of the removed exhaust manifold stud(s) in the original exhaust manifold.

Some exemplary embodiments of the clamp may include a substantially rectangular shaped frame that includes an aperture that is adapted to be secured over and around a protrusion of an exhaust manifold. Additionally, the clamp may include a fastener secured to the frame that is adapted to join with an exhaust pipe bracket.

In addition to the novel features and advantages mentioned above, other features and advantages will be readily apparent from the following descriptions of the drawings and exemplary embodiments.

DETAILED DESCRIPTION OF EXEMPLARY EMBODIMENT(S)

Figure 1A:
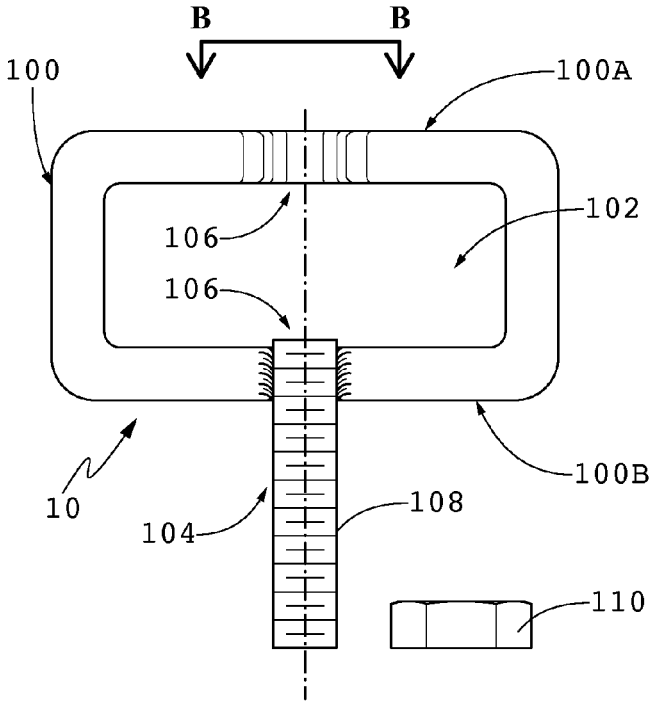
FIGS. 1A-1C are cross-sectional views of an exemplary embodiment of a clamp of the present invention.

FIG. 1A illustrates an exemplary embodiment of the clamp apparatus 10 of the present invention. In this example, the clamp 10 has a frame 100 with an upper and lower end **100*a*, 100*b*. The frame 100 includes an aperture 102 that is adapted to be secured around a protrusion of an exhaust manifold and a fastener 104 secured to the frame 100** that is adapted to join with an exhaust pipe.

In this exemplary embodiment, the frame 100 is substantially rectangular in shape. Although the frame 100 of this exemplary embodiment is substantially rectangular in shape, other exemplary embodiments may be any geometry that allow for proper securement of the clamp 10 around a protrusion of an exhaust manifold.

Typically, the cross-sectional geometry of the frame 100 of this exemplary embodiment is substantially rectangular to allow the frame to secure with a protrusion of an exhaust manifold. In some exemplary embodiments, the frame is fabricated from stamped metal. However, other exemplary embodiments may be fabricated by readily available bar stock that are shaped and secured together by welding or other suitable securing.

Figure 1C:
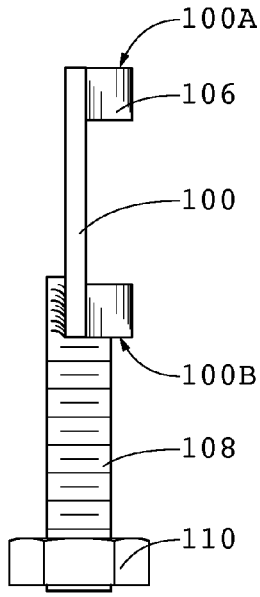
Figure 1B:
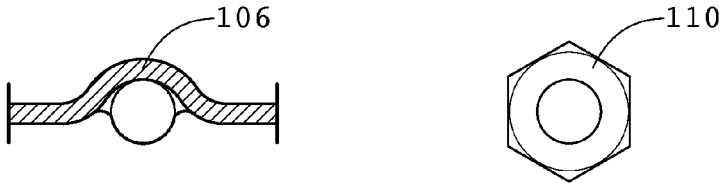

In some exemplary embodiments, the frame 100 may include a depression, best shown in FIG. 1B) in either the upper or lower ends 100*a*, 100*b*. In this particular embodiment, a depression 106 is located at substantially the midpoint of both the upper and lower ends 100*a*, 100*b* of the frame 100. The depression 106 on the upper end 100*a* may facilitate securement of the clamp 10 around the protrusion of the exhaust manifold. The depression 106 of the upper end 100*a* may accommodate a rusted fastener (stud bolt) not readily removable. The depression 106 of the lower end 100*b* may also facilitate proper alignment of the fastener 104 with the exhaust piping and accommodate any stud portion left over.

The frame 100 may be fabricated from materials suitable for use with a high temperature exhaust system, including, but not limited to: metals (such as steel or aluminum), fiberglass, or even durable plastics. The frame 100 has sufficient strength to permit proper operation of the clamp 10. Also, it is preferred that the material used to construct the frame 100 is resistant to corrosion, especially corrosion from salt. To this extent, some exemplary embodiments of the frame 100 may include a corrosion resistant coating that may be applied to some portion or the entire frame 100. A frame of the clamp may be provided with one or more grip assisting features that assist the frame to secure with the exhaust manifold protrusion. For example, in some embodiments, the frame 100 may have a knurled texture. A variety of other textures and/or treatments for improving grip and hold may also be applied.

An aperture 102 is included that is adapted to secure over and around a protrusion of the exhaust manifold. The aperture 102 of this particular embodiment is substantially rectangular, with rounded corners. However, other embodiments may include an aperture 102 of varying shape, depending upon the shape of the protrusion of the exhaust manifold around which the aperture is designed to secure. The aperture 102 may follow the exterior shape of the frame 100 so that the frame 100 may be fabricated from common bar stock to reduce fabrication expenses.

Exemplary embodiments of the clamp 10 include a fastener 104 secured to the frame that is adapted to join with an exhaust pipe. Typically, the fastener 104 is previously secured to the frame 100 by welding. However, in other exemplary embodiments, the fastener 104 may be secured to the frame 100 by other securement devices. It is also possible for the fastener 104 to be integral with the frame 100, such as by molding, turning, or casting, or other manufacturing techniques.

In this particular embodiment, the fastener 104 is a threaded fastener 108 with a corresponding nut 110 (as best shown in FIG. 1C). However, other known fasteners may be used. One end of the fastener 104 may be secured adjacent the lower end depression 106 of the frame 100 in exemplary embodiments that include a lower end depression.

The fastener 104 may be fabricated from any number of materials, including, but not limited to various metals. Preferably, the fastener 100 has sufficient strength to permit proper operation of the clamp 10 during the cyclical vibration of the exhaust manifold and piping. Also, it is preferred that the material used to construct the fastener 104 is resistant to corrosion, especially corrosion from salt. To this extent, some exemplary embodiments of the fastener 104 may include a corrosion resistant coating that may be applied to some portion or the entire fastener 104.

Figure 2:
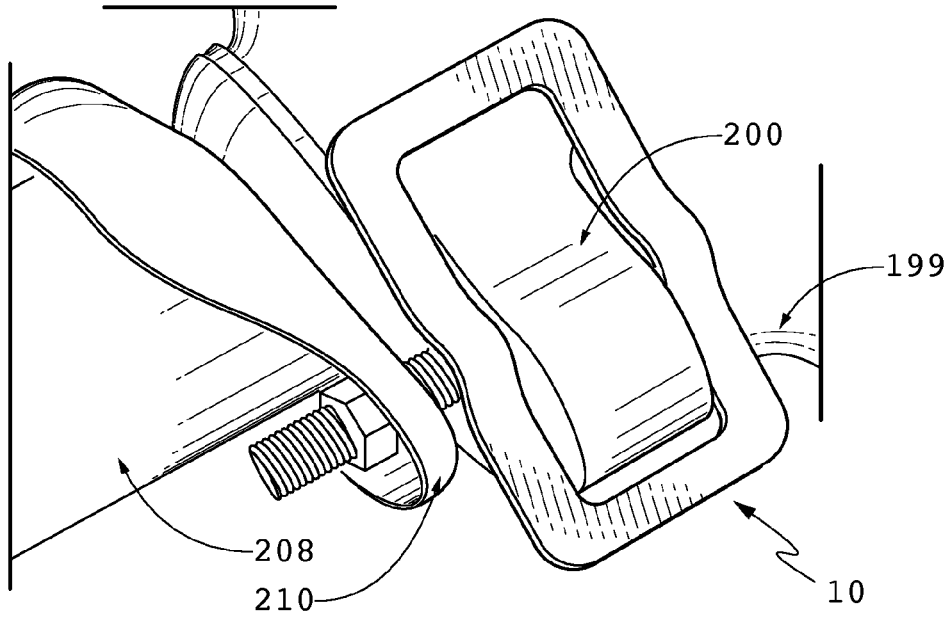
FIG. 2 is a perspective view of an exemplary embodiment of a clamp of the present invention securing an exhaust manifold and exhaust piping.
Figure 3:
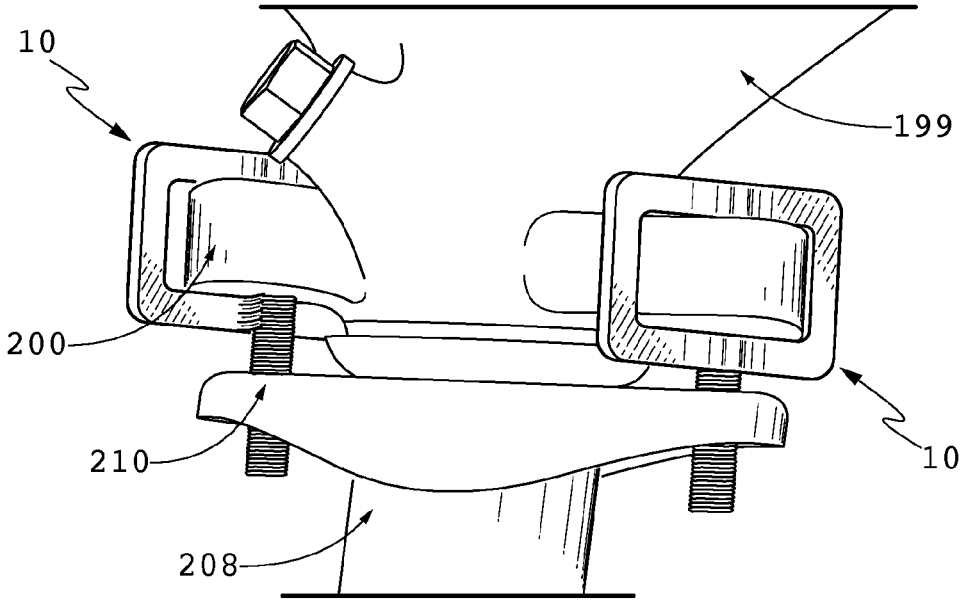
FIG. 3 is a perspective view of an exemplary embodiment of two clamps of the present invention securing an exhaust manifold and exhaust piping.

As shown in FIGS. 2 and 3, in operation, an exemplary embodiment of the clamp 10 is shown installed around a protrusion 200 of a manifold exhaust 199 on a Ford F150 pickup truck. The fastener is then engaged with a bracket 210 of the exhaust piping 208. The fastener is then tightened, bringing the manifold and exhaust piping into proper alignment and securement with respect to each other.

In practicing exemplary embodiments of the method it may be necessary to remove the existing damaged studs from the exhaust manifold. Typically, the existing damaged studs may be cleared from the exhaust manifold by several known methods common to a muffler installation repair facility, including, but not limited to: cutting the damaged stud with an oxy-acetylene or plasma torch at the point even with and parallel to the mounting surface of the exhaust manifold. This particular operation of removing all or a portion of the studs may sufficiently clear the stud mounting area of the remaining damaged stud(s) obstruction for restoration using an exemplary embodiment of the clamp 10 described above. The removal of the existing studs is normally accomplished while the exhaust manifold is mounted on the motor.

Typically, after the exhaust manifold studs are removed, no further preparation of the exhaust manifold is required to restore the exhaust manifold connection with the exhaust piping. After the existing studs are removed, in whole or sufficient part, an installer may secure the clamp to the exhaust manifold by sliding the frame around the protrusion of the exhaust manifold, sometimes commonly called a manifold "ear", and engaging at least a portion of the aperture with the protrusion of the exhaust manifold in a manner so that the fastener of the clamp is aligned in a position which mirrors the original position of the removed exhaust manifold stud(s) in the original exhaust manifold. Typically, at least the upper portion of the aperture will engage the manifold ear. Furthermore, in exemplary embodiments of the clamp that include depressions, typically the depressions are situated so that the indent of the depression accommodates any remaining portion of pre-existing studs found in the original equipment when on the vehicle from the factory.

Figure 4:
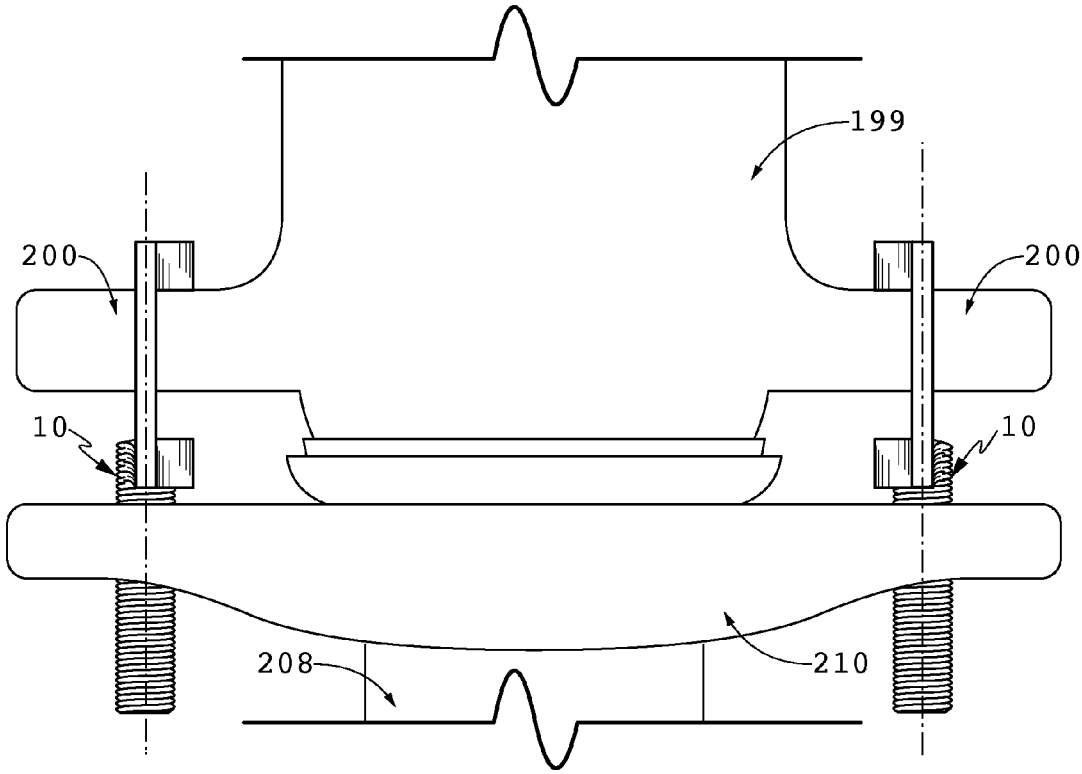
FIG. 4 is a perspective view of an exemplary embodiment of a clamp of the present invention securing an exhaust manifold and exhaust piping.

After the clamp is properly aligned on the exhaust manifold ear, the fastener is joined with the exhaust piping. In the exemplary embodiment of the clamp that uses a threaded fastener and corresponding nut, the threaded fastener is engaged within a hole found through a flange (or bracket) of the exhaust piping that corresponds to the original exhaust manifold studs. A second clamp is preferably secured in a like manner over the opposing manifold ear, as best shown in FIG. 4. After the holes are engaged by the threaded fasteners, nuts are engaged to the threaded fasteners and tightened. Preferably, the nuts are tightened to the original torque specification as recommended by the vehicle or motor manufacturer.

In some exemplary embodiments of the present invention, it is possible to use an adhesive material to further generate increased retention force between the threaded fastener and the nut. When used, an adhesive material may be applied to either or both of the thread fastener or inside of the nut. Likewise, an adhesive material may be used to further increase the lifetime of the clamp connection to the exhaust manifold.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. An exhaust clamp apparatus comprising:

a substantially rectangular frame comprising an uninterrupted loop of metal, the majority of which lies in a single plane, the frame including an upper and a lower end, the upper and lower end include a depression for accommodating a portion of a pre-existing exhaust manifold stud, and the loop defines an aperture that is adapted to be secured over an exhaust manifold protrusion;

a fastener extending downward from the lower end of the frame and adapted to join with an exhaust pipe flange, such that the exhaust manifold protrusion and exhaust pipe flange are secured together by the clamp apparatus.

2. The clamp of claim 1, wherein the fastener is a threaded protrusion with a corresponding nut.

3. The clamp of claim 1, wherein the fastener is welded to the frame.

4. The claim of claim 1, wherein the fastener is secured within the lower end depression of the frame.

5. The clamp of claim 1, wherein the depressions comprise concave sections of frame.

6. The clamp of claim 1, wherein the frame and fastener are integral to one another.

* * * * *